US005681150A

United States Patent [19]

Kawaguchi et al.

[11] Patent Number: 5,681,150

[45] Date of Patent: Oct. 28, 1997

[54] PISTON TYPE VARIABLE DISPLACEMENT COMPRESSOR

[75] Inventors: Masahiro Kawaguchi; Masanori Sonobe; Ken Suitou; Tomohiko Yokono, all of Kariya, Japan

[73] Assignee: Kabushiki Kaisha Toyoda Jidoshokki Seisakusho, Kariya, Japan

[21] Appl. No.: 438,386

[22] Filed: May 10, 1995

Related U.S. Application Data

[63] Continuation-in-part of Ser. No. 421,215, Apr. 13, 1995, Pat. No. 5,584,670, which is a continuation-in-part of Ser. No. 361,111, Dec. 21, 1994, Pat. No. 5,603,610, which is a continuation-in-part of Ser. No. 255,043, Jun. 7, 1994, abandoned.

[30] Foreign Application Priority Data

May 12, 1994 [JP] Japan ..... 6-098946

[51] Int. Cl.[6] ..... F04B 1/29

[52] U.S. Cl. ..... 417/222.2; 417/295

[58] Field of Search ..... 417/222.2, 222.1, 417/295, 269; 91/480, 499

[56] References Cited

U.S. PATENT DOCUMENTS

| | | | |
|---|---|---|---|
| 4,801,248 | 1/1989 | Tojo et al. | 417/222.2 |
| 4,913,626 | 4/1990 | Terauchi | 417/222.2 |
| 5,017,096 | 5/1991 | Sugiura et al. | 417/222.2 |
| 5,105,728 | 4/1992 | Hayase et al. | 92/71 |
| 5,173,032 | 12/1992 | Taguchi et al. | 417/222.2 |
| 5,577,894 | 11/1996 | Kawagchi et al. | 417/222.2 |
| 5,584,670 | 12/1996 | Kawaguchi et al. | 417/222.2 |

FOREIGN PATENT DOCUMENTS

| | | |
|---|---|---|
| 3711979 | 10/1987 | Germany . |
| 4015006 | 11/1990 | Germany . |
| 4019027 | 12/1990 | Germany . |
| 4033422 | 4/1992 | Germany . |
| 4344818 | 7/1994 | Germany . |
| 4439512 | 5/1995 | Germany . |
| 4446087 | 6/1995 | Germany . |
| 4446832 | 6/1995 | Germany . |

*Primary Examiner*—Michael Koczo
*Assistant Examiner*—Peter G. Korytnyk
*Attorney, Agent, or Firm*—Brooks Haidt Haffner & Delahunty

[57] ABSTRACT

A compressor has a swash plate tiltable between a maximum and minimum inclining angles with respect to an axis of the drive shaft according to a difference between pressures in a crank chamber and a suction chamber. An electromagnetic valve is disposed in a pressure passage, and opens or closes the pressure passage according to instruction of an external computer. This instruction is based on an operation status of the compressor so that the electromagnetic valve adjusts the pressure in the crank chamber. The pressure passage connects the crank chamber and the suction chamber. The swash plate is inclined toward the maximum inclining angle when the pressure passage is open to release the pressure in the crank chamber to the suction chamber. The swash plate is inclined toward the minimum inclining angle when the pressure passage is closed to increase the pressure in the crank chamber. A disconnecting element is disposed between the external circuit and the suction chamber to disconnect the external circuit with the suction chamber in association with the swash plate driven to the minimum inclining angle.

20 Claims, 13 Drawing Sheets

PISTON TYPE VARIABLE DISPLACEMENT COMPRESSOR

CROSS REFERENCE TO RELATED APPLICATION

This application is a continuation-in-part of U.S. patent application Ser. No. 08/421,215 filed Apr. 13, 1995 now U.S. Pat. No. 5,584,670, which is a continuation-in-part of U.S. patent application Ser. No. 08/361,111 filed Dec. 21, 1994 now U.S. Pat. No. 5,603,610, which is a continuation-in-part of U.S. patent application Ser. No. 08/225,043 filed Jun. 7, 1994, abandoned, all of which are incorporated herein by reference.

BACKGROUND OF THE INVENTION

1. Field of the Invention

The present invention relates to a piston-type variable displacement compressor. More specifically, this invention relates to a piston-type variable displacement compressor capable of efficiently adjusting the pressure in the crank chamber.

2. Description of the Related Art

In general, compressors are mounted in vehicles to supply compressed refrigerant gas to the vehicle's air conditioning system. To maintain air temperature inside the vehicle at a level comfortable for the vehicle's passengers, it is important to utilize a compressor whose displacement is controllable. One known compressor of this type controls the inclined angle of a swash plate, tiltably supported on a drive shaft, based on the difference between the pressure in a crank chamber and the suction pressure, and converts the rotational motion of the swash plate to the reciprocal linear motion of each piston.

A conventional piston type compressor disclosed in U.S. Pat. No. 5,173,032 uses no electromagnetic clutch for the transmission and blocking of power between an external driving source and the drive shaft of the compressor. The external driving source is coupled directly to the drive shaft.

The clutchless structure with the driving source coupled directly to the drive shaft can eliminate shocks which are produced by the ON/OFF action of such a clutch. When such a compressor is used in a vehicle, passenger comfort is improved. The clutchless structure also reduces the overall weight and cost of the cooling system.

In such a clutchless system, the compressor runs even when no cooling is needed. With such type of compressors, it is important that, when cooling is unnecessary, the discharge displacement is reduced as much as possible to prevent frosting of the evaporator. When no cooling is needed or there is a probability of frosting, the circulation of the refrigerant gas through the compressor and its external refrigeration circuit should be stopped. The compressor described in the aforementioned U.S. patent is designed to block the flow of gas into the suction chamber from the external refrigeration circuit by the use of an electromagnetic valve.

In the compressor described above, when the circulation of the gas from the external refrigeration circuit to the suction chamber is blocked, the pressure in the suction chamber drops and the control valve responsive to that pressure opens fully. The full opening of the control valve allows the gas in the discharge chamber to flow into the crank chamber, which in turn raises the pressure inside the crank chamber.

When the pressure in the suction chamber falls, the suction pressure in the cylinder bores falls, thus increasing the difference between the pressure in the crank chamber and the pressure in the cylinder bores. This pressure differential in turn minimizes the inclination of the swash plate which reciprocates the pistons. As a result, the discharge displacement becomes minimum. At this time, the driving torque needed by the compressor is minimized, thus reducing power loss as much as possible.

When the gas flow to the suction chamber from the external refrigeration circuit starts again, the pressure in the suction chamber rises, and then the control valve closes. This inhibits the gas flow into the crank chamber from the discharge chamber, which lowers the pressure in the crank chamber. As the pressure in the suction chamber rises, the suction pressure in the cylinder bores rises too. The difference between the pressure in the crank chamber and the pressure in the cylinder bores therefore becomes smaller, and the inclined angle of the swash plate becomes maximum, maximizing the discharge displacement. At this time, the torque needed to drive the compressor becomes maximum.

The aforementioned electromagnetic valve performs a simple ON/OFF action to instantaneously stop or restart the gas flow from the external refrigerant circuit into the suction chamber. Accordingly, the amount of gas supplied into the cylinder bores from the suction chamber decreases or increases drastically. This rapid change in the amount of gas flowing into the cylinder bores causes an abrupt change in the discharge displacement, rapidly decreasing or increasing the discharge pressure. Consequently, the driving torque needed to drive the compressor greatly changes over a short period of time, causing rather large shock.

SUMMARY OF THE INVENTION

Accordingly, it is a primary objective of the present invention to provide a compressor capable of suppressing a drastic change in torque needed to drive the compressor.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENT

Figure 1:
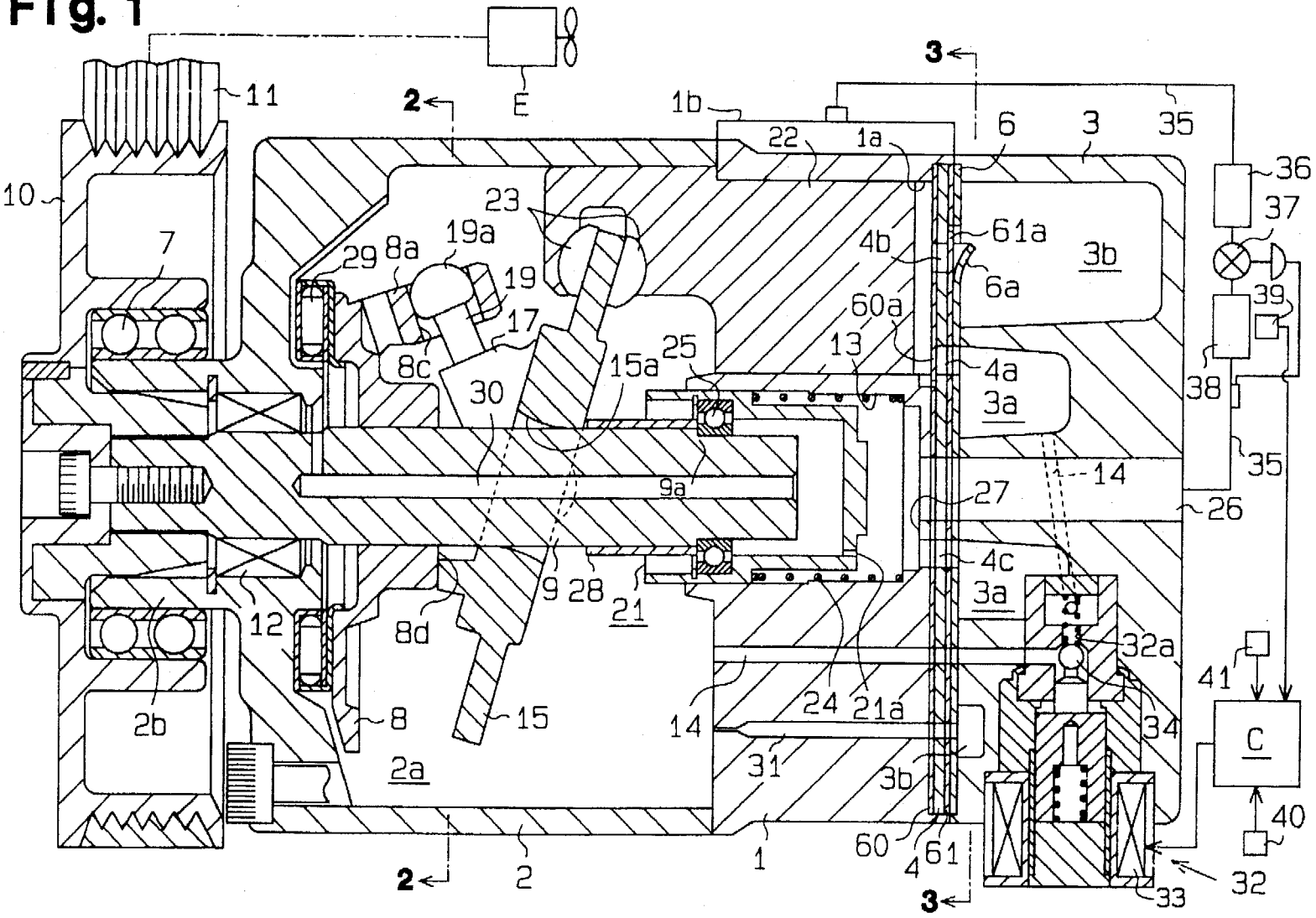
FIG. 1 is a side cross-sectional view of an overall compressor according to the first embodiment of the present invention.

A compressor according to a first embodiment of the present invention will now be described with reference to FIGS. 1 through 6. FIG. 1 presents a cross-sectional view showing the overall compressor. The outline of the compressor will be discussed with reference to FIG. 1. A cylinder block 1 constitutes a part of the housing of the compressor. A front housing 2 is secured to the front end of the cylinder block 1. A rear housing 3 is secured to the rear end of the cylinder block 1 via a first plate 4, a second plate 60, a third plate 61 and a fourth plate 6. The front housing 2 defines a crank chamber 2*a*. A drive shaft 9 is supported rotatably on the front housing 2 and the cylinder block 1. The front end of the drive shaft 9 protrudes outside the crank chamber 2*a*, with a pulley 10 secured to this front end. The pulley 10 is functionally coupled to the engine E of a vehicle via a belt 11.

A support pipe 2*b* protrudes from the front end of the front housing 2 in such a way as to surround the front end of the drive shaft 9. The pulley 10 is supported via an angular bearing 7 on the support pipe 2*b*. Through the angular bearing 7, the support pipe 2*b* receives both the thrust load and radial load which act on the pulley 10. Between the front end of the drive shaft 9 and the front housing 2 is a lip seal 12 which prevents pressure leakage from the crank chamber 2*a*.

Figure 2:
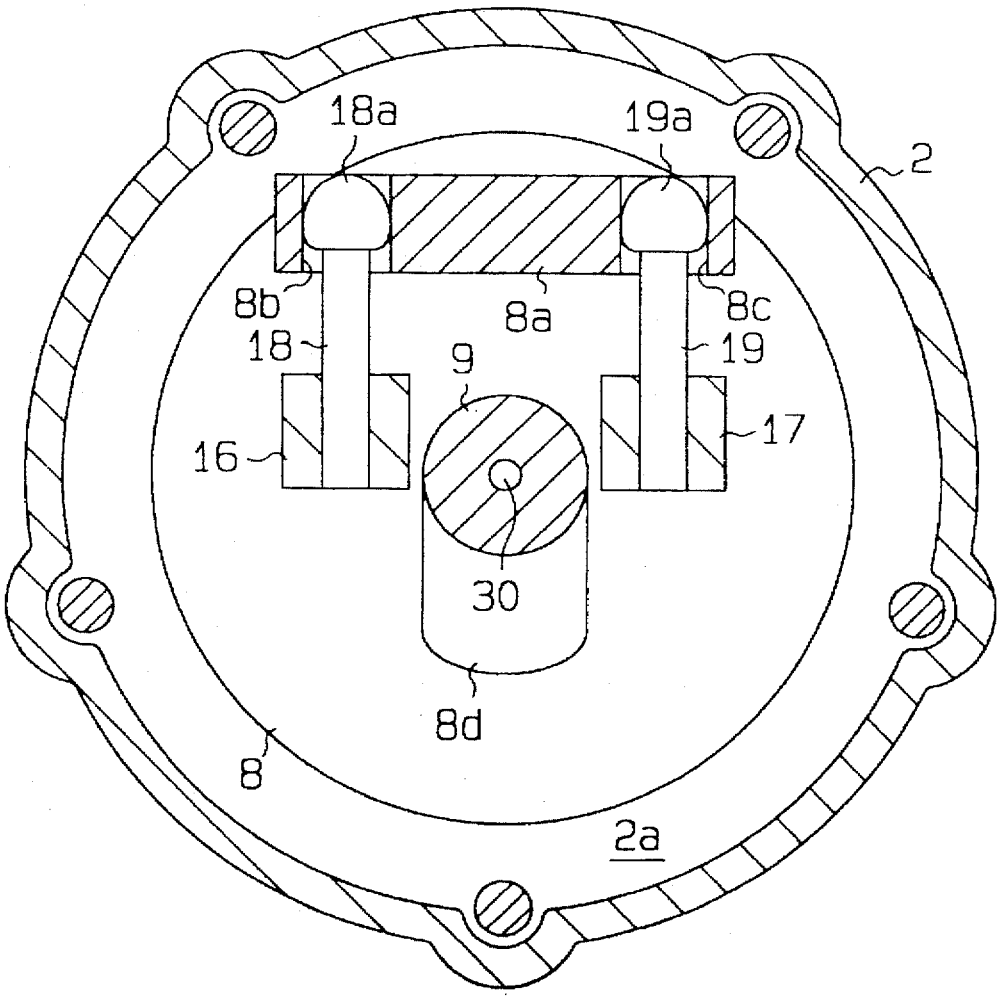
FIG. 2 is a cross-sectional view taken along the line 2—2 in FIG. 1.

A guide hole 15*a* is formed in the center portion of a swash plate 15. The swash plate 15 is supported by the drive shaft 9 in such a way as to be slidable along and tiltable with respect to the axis of this shaft 9 via the guide hole 15*a*. As shown in FIGS. 1 and 2, a pair of stays 16 and 17 are secured to the swash plate 15, with guide pins 18 and 19 fixed to the respective stays 16 and 17. Guide balls 18*a* and 19*a* are formed at the distal ends of the respective guide pins 18 and 19. A drive plate 8 is fixed to the drive shaft 9. The drive plate 8 has a support arm 8*a* protruding toward the swash plate 15 (rearward) from the drive plate 6. A pair of guide holes 8*b* and 8*c* are formed in the arm 8*a*, and the guide balls 18*a* and 19*a* are slidably fitted in the associated guide holes 8*b* and 8*c*. The cooperation of the arm 8*a* and the guide pins 18 and 19 permits the swash plate 15 to rotate together with the drive shaft 9 and to tilt with respect to the drive shaft 9.

A plurality of cylinder bores 1*a*are formed in the cylinder block 1 in such a way as to communicate with the crank chamber 2*a*. Single-headed pistons 22 are retained in the associated cylinder bores 1*a*. The hemispherical portions of a pair of shoes 23 are fitted on each piston 22 in a mutually slidable manner. The swash plate 15 is held between the flat portions of both shoes 23. Accordingly, the undulation of the swash plate 15 caused by the rotation of the drive shaft 9 is transmitted via the shoes 23 to each piston 22, so that the piston 22 reciprocates in the associated cylinder bore 1*a* in accordance with the inclination of the swash plate 15.

Figure 3:
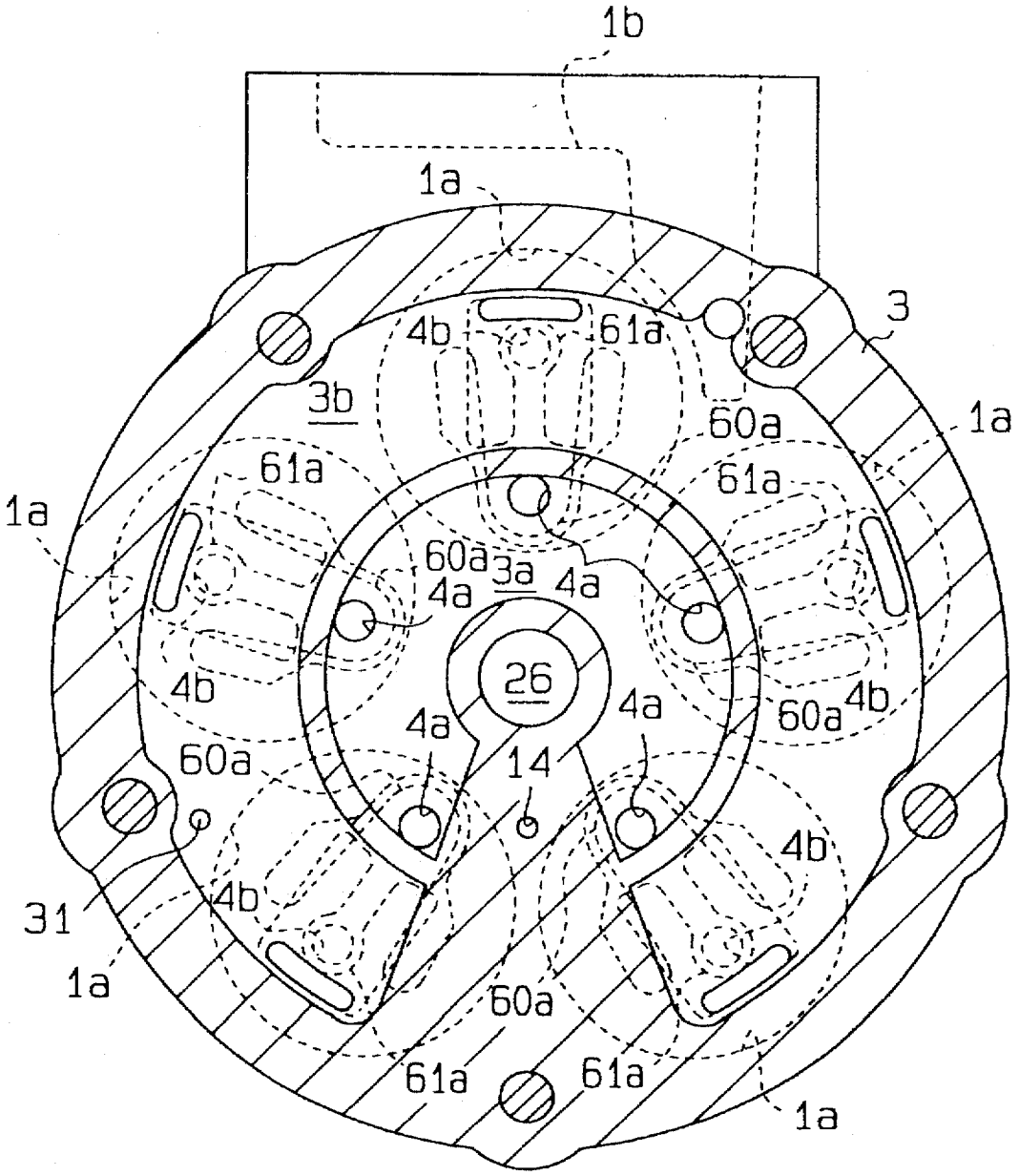
FIG. 3 is a cross-sectional view taken along the line 3—3 in FIG. 1.

As shown in FIGS. 1 and 3, a suction chamber 3*a* and a discharge chamber 3*b* are defined in the rear housing 3. Suction ports 4*a* and discharge ports 4*b* are formed in the first plate 4. Suction valves 60*a* are formed on the second plate 60, and discharge valves 61*a* are formed on the third plate 61. As the pistons 22 move backward, the refrigerant gas in the suction chamber 3*a* forces the suction valves 60*a* open through the suction ports 4*a* and enters the cylinder bores 1*a*. As the pistons 22 move forward, the refrigerant gases in the cylinder bores 1*a* force the discharge valves 61*a* open through the discharge ports 4*b* and enter the discharge chamber 3*b*. As each discharge valve 61*a* abuts on a retainer 6*a* on the fourth plate 6 the amount the associated discharge valve opens 61*a* is restricted.

A thrust bearing 29 is placed between the drive plate 8 and the front housing 2. This thrust bearing 29 receives the compressive reaction force that acts on the drive plate 8 via the pistons 22, the swash plate 15, etc.

Figure 4:
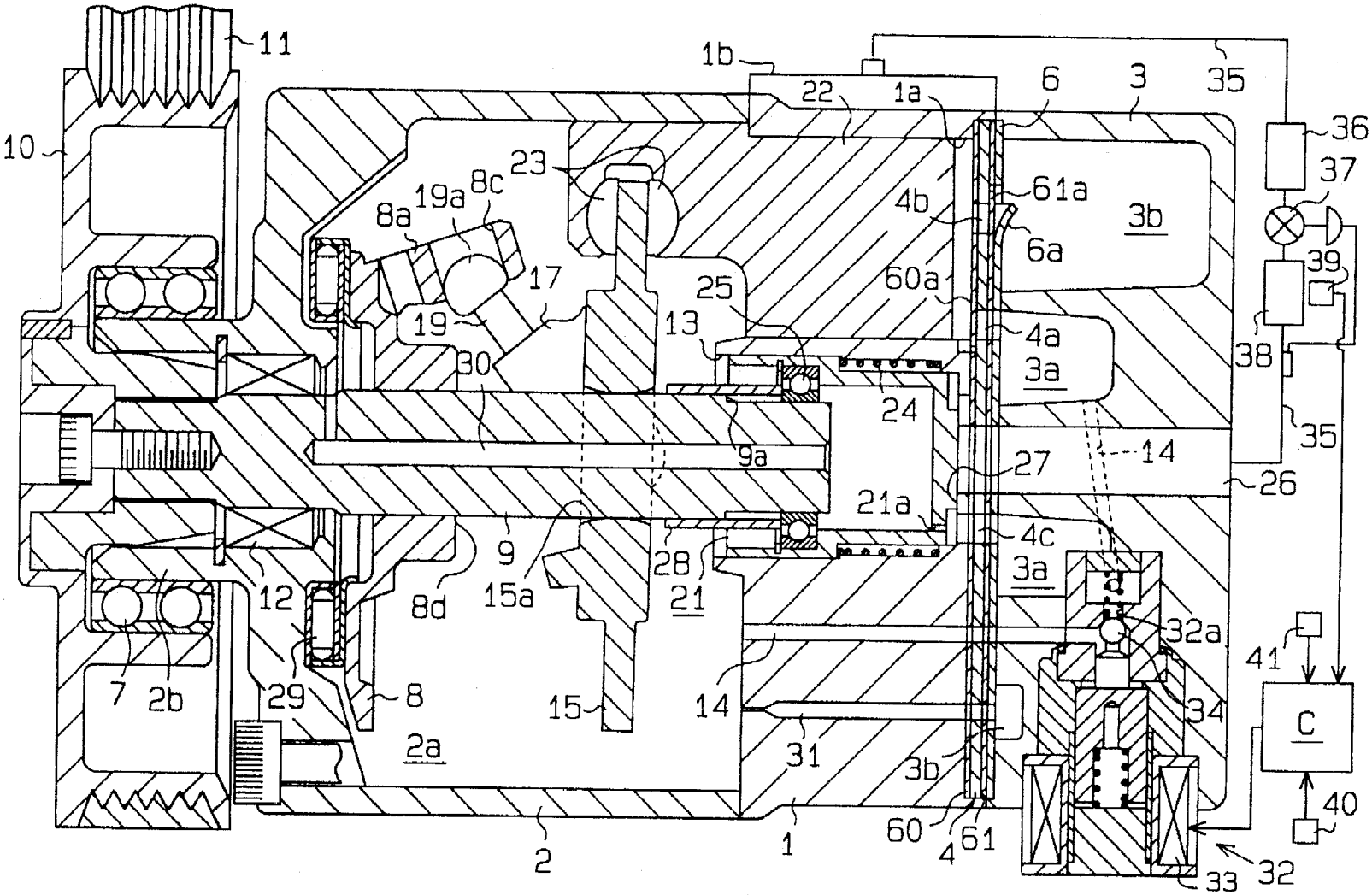
FIG. 4 is a side cross-sectional view of the whole compressor whose swash plate is at a minimum inclined angle.
Figure 5:
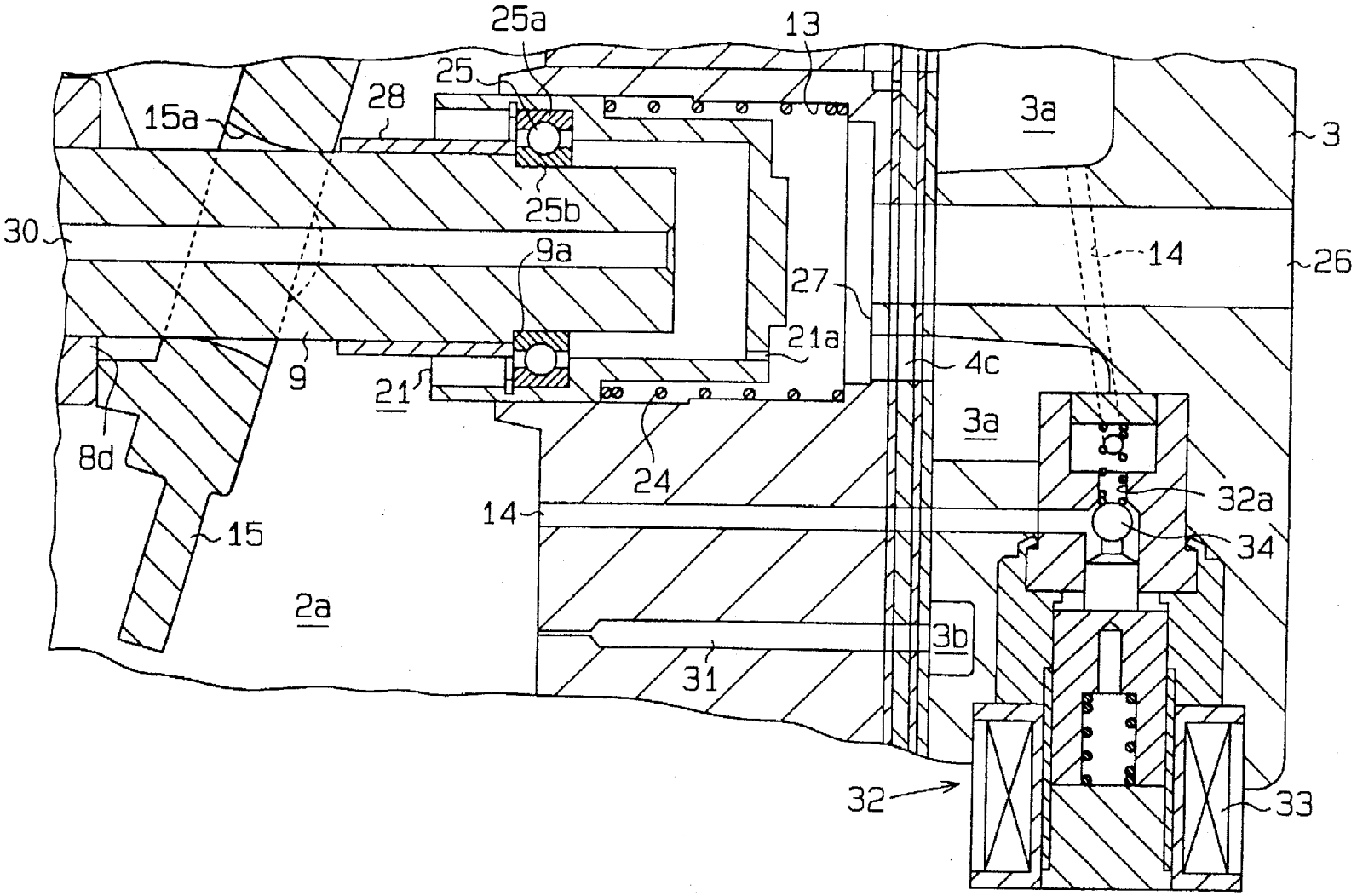
FIG. 5 is an enlarged cross-sectional view of essential parts showing the compressor whose swash plate is at a maximum inclined angle.

As shown in FIGS. 1, 4 and 5, a shutter chamber 13 is formed in the center portion of the cylinder block 1, extending along the axis of the drive shaft 9. A cylindrical spool 21 having one closed end is slidably accommodated in the shutter chamber 13. A spring 24 is located between the spool 21 and the inner wall of the shutter chamber 13. The spring 24 urges the spool 21 toward the swash plate 15.

The rear end of the drive shaft 9 is inserted in the spool 21. A ball bearing 25 is located between the rear end of the drive shaft 9 and the inner wall of the spool 21. The ball bearing 25 receives loads in the radial direction and the thrust direction that are applied to the drive shaft 9. The rear end of the drive shaft 9 is supported by the inner wall of the shutter chamber 13 via the ball bearing 25 and the spool 21. The ball bearing 25 has an outer race 25*a* fixed to the inner wall of the spool 21 and an inner race 25*b* which is slidable along the outer surface of the drive shaft 9.

As shown in FIG. 5, a step portion 9*a* is formed on the rear outer surface of the drive shaft 9. The engagement of the inner race 25*b* of the ball bearing 25 and this step portion 9*a* inhibits the movement of the ball bearing 25 toward the swash plate 15 (frontward). At the same time, the engagement prohibits the spool 21 from moving toward the swash plate 15.

A suction passage 26 is formed in the center portion of the rear housing 3. This suction passage 26 communicates with the shutter chamber 13. A positioning surface 27 is formed on the cylinder block 1 between the shutter chamber 13 and the suction passage 26. The distal end of the spool 21 is abuttable on the positioning surface 27. As the distal end of the spool 21 abuts on the positioning surface 27, the movement of the spool 21 away from the swash plate 15 or in the rearward direction is restricted and the suction passage 26 is disconnected from the shutter chamber 13.

A pipe 28 is slidably attached to the drive shaft 9 between the swash plate 15 and the ball bearing 25. The front end of the pipe 28 is abuttable on the rear end face of the swash plate 15. The rear end of the pipe 28 does not contact the outer race 25*a* of the ball bearing 25 but contacts only the inner race 25*b*.

As the swash plate 15 moves rearward, it abuts on the pipe 28. The pipe 28 in turn pushes the inner race 25*b* of the ball bearing 25. As a result, the spool 21 moves toward the positioning surface 27 against the urging force of the spring 24 and the distal end of the spool 21 abuts on the positioning surface 27. At this time, the inclined angle of the swash plate 15 is restricted to be minimized. The minimum inclined angle of the swash plate 15 is slightly larger than zero degrees. An incline of zero degrees is defined as the incline of the swash plate 15 when the plane of the swash plate is perpendicular to the drive shaft 9.

Figure 6:
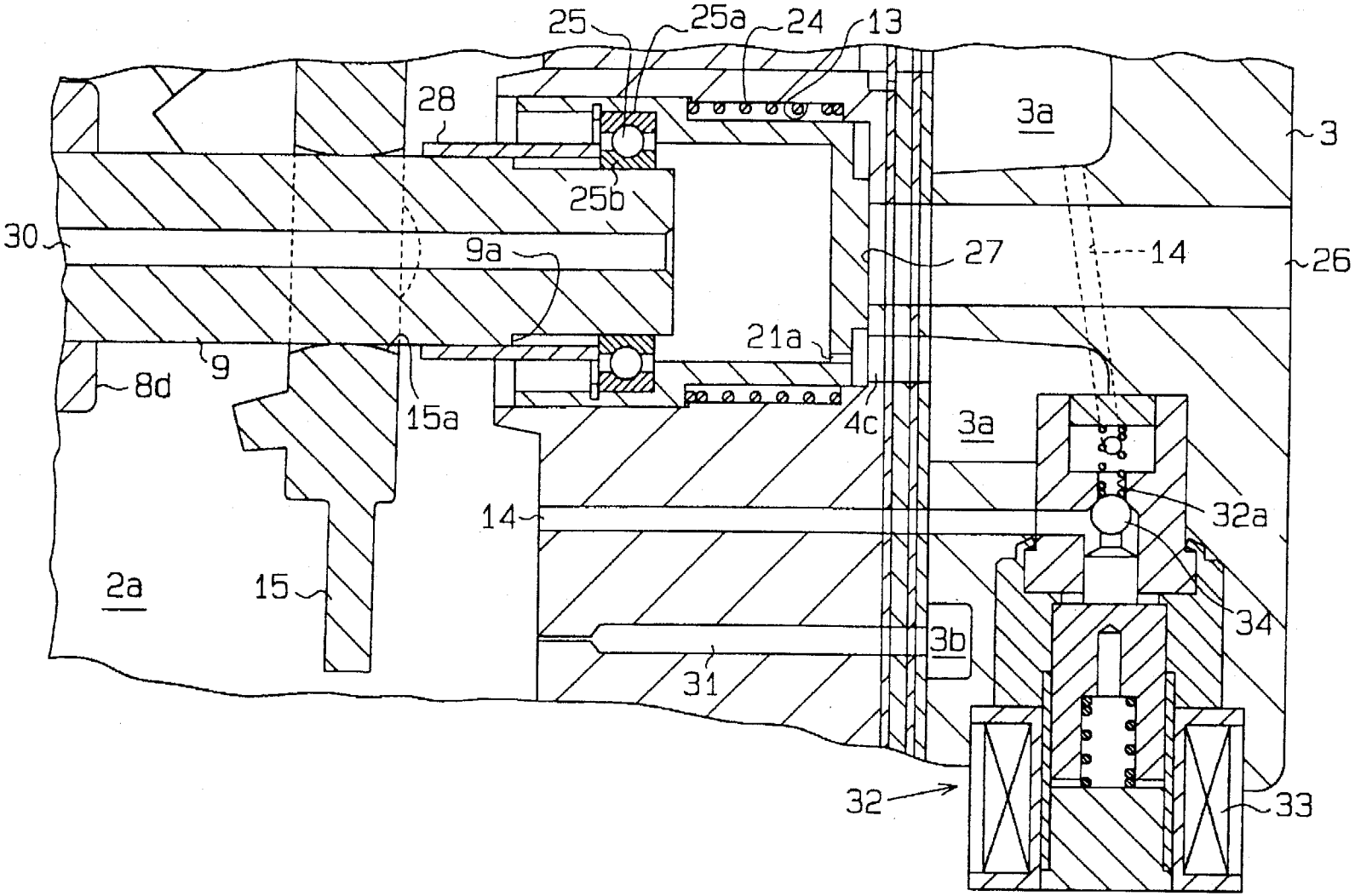
FIG. 6 is an enlarged cross-sectional view of essential parts showing the compressor whose swash plate is at the minimum inclined angle.

When the inclined angle of the swash plate 15 reaches the minimum, the spool 21 comes to a closed position to disconnect the suction passage 26 from the shutter chamber 13, as shown in FIG. 6. The spool 21 is movable between this closed position and an open position (see FIG. 5) spaced from the closed position, and is positioned in response to the movement of the swash plate 15. As shown in FIG. 1, abutting on a projection 8*d* of the drive plate 8, the swash plate 15 is restricted not to incline beyond a predetermined maximum inclined angle.

The suction chamber 3*a* communicates with the shutter chamber 13 via a communication hole 4*c* which passes through the individual plates 4, 60, 61 and 6. This communication hole 4*c* is blocked from the suction passage 26 when the spool 21 is in the closed position. The suction passage 26 forms an inlet to supply the refrigerant gas into the compressor. Therefore, the spool 21 blocks the passage of the refrigerant gas from the suction passage 26 to the suction chamber 3*a* downstream of that inlet.

As shown in FIG. 1, a passage 30 is formed in the drive shaft 9. The passage 30 connects the crank chamber 2*a* to the interior of the spool 21. As shown in FIGS. 1, 4 and 5, a through hole 21*a* is formed in the distal end of the spool 21. As shown in FIGS. 1 and 5, when the swash plate 15 is at the maximum inclined angle, the interior of the spool 21 communicates with the shutter chamber 13 via the through hole 21*a*. When the swash plate 15 is at the minimum inclined angle, the interior of the spool 21 communicates with the communication hole 4*c* via the through hole 21*a*, as shown in FIGS. 4 and 6. Accordingly, the crank chamber 2*a* always communicates with the suction chamber 3*a* via the passage 30, the interior of the spool 21, the through hole 21*a* and the communication hole 4*c*.

As shown in FIGS. 1 and 4, a pressure decreasing passage 14 connects the crank chamber 2*a* to the suction chamber 3*a*. An electromagnetic valve 32 is attached to the rear housing 3 and is located midway in the pressure decreasing passage 14. When the solenoid 33 of the electromagnetic valve 32 is excited, a valve body 34 opens a valve hole 32*a* as shown in FIG. 1. When the solenoid 33 is de-excited, the valve body 34 closes the valve hole 32*a* as shown in FIG. 4. Therefore, the electromagnetic valve 32 selectively opens or closes the pressure decreasing passage 14 between the crank chamber 2*a* and the suction chamber 3*a*.

A supply passage 31 connects the discharge chamber 3*b* to the crank chamber 2*a*. The refrigerant gas in the discharge chamber 3*b* is always supplied to the crank chamber 2*a* via the supply passage 31.

An external refrigeration circuit 35 connects the suction passage 26 for supplying the refrigerant gas into the suction chamber 3*a* to the outlet port 1*b* for discharging the refrigerant gas from the discharge chamber 3*b*. Provided above the external refrigeration circuit 35 are a condenser 36, an expansion valve 37 and an evaporator 38. The expansion valve 37 controls the flow rate of the refrigerant in accordance with a change in gas pressure on the outlet side of the evaporator 38.

A temperature sensor 39 is located near the evaporator 38. The temperature sensor 39 detects the temperature in the evaporator 38, and outputs a signal based on the detected temperature to a computer C. An engine speed sensor 41 detects the rotational speed of the engine E and outputs a signal based on the detected engine speed to the computer C.

The computer C controls the solenoid 33 of the electromagnetic valve 32. More specifically, the computer C excites or de-excites the solenoid 33 based on the ON action or OFF action of an activation switch 40 for activating the air conditioning system. When the temperature detected by the temperature sensor 39 becomes equal to or below a set value with the activation switch 40 set on, the computer C de-excites the solenoid 33. At a temperature equal to or below this set value, frosting may occur in the evaporator 38. Further, when the engine speed detected by the engine speed sensor 41 changes abruptly with the activation switch 40 set on, the computer C de-excites the solenoid 33.

The operation of the compressor will now be described.

Referring to FIGS. 1 and 5, the solenoid 33 is excited and the pressure decreasing passage 14 is opened. In this situation, the refrigerant gas in the crank chamber 2*a* flows out to the suction chamber 3*a* via the pressure decreasing passage 14 and the passage 30. Therefore, the pressure in the crank chamber 2*a* approaches the low pressure in the suction chamber 3*a*, i.e., the suction pressure. As a result, the difference between the pressure in the crank chamber 2*a* and the pressure in the cylinder bores 1*a* becomes smaller and the inclined angle of the swash plate 15 is maximized. The discharge displacement of the compressor is thus maximized.

When the gas is discharged with the swash plate 15 kept at the maximum inclined angle while the cooling load of the compressor becomes lower, the temperature in the evaporator 38 falls to approach the value that may cause frosting. When the temperature detected by the temperature sensor 39 becomes equal to or lower than the set value, the computer C de-excites the solenoid 33. When the solenoid 33 is de-excited, the pressure decreasing passage 14 is closed to disconnect the crank chamber 2*a* from the suction chamber 3*a*. Consequently, the refrigerant gas in the crank chamber 2*a* stops flowing into the suction chamber 3*a* via the pressure decreasing passage 14. At the same time, blow-by gas is supplied to the crank chamber 2*a* from the cylinder bores 1*a*. Further, the refrigerant gas is also supplied to the crank chamber 2*a* from the discharge chamber 3*b* through the supply passage 31. This raises the pressure in the crank chamber 2*a*. The difference between the pressure in the crank chamber 2*a* and the pressure in the cylinder bores 1*a* therefore increases and the inclined angle of the swash plate 15 becomes smaller.

As the inclined angle of the swash plate 15 becomes smaller, the spool 21 is pushed backward via the pipe 28 and the ball bearing 25. Consequently, the distal end of the spool 21 approaches the positioning surface 27. This movement gradually restricts the cross-sectional area of the passage extending from the suction passage 26 to the suction chamber 3*a*. The amount of the refrigerant gas flowing into the suction chamber 3*a* from the suction passage 26 therefore decreases gradually. As a result, the amount of the refrigerant gas sucked into the cylinder bores 1*a* from the suction chamber 3*a* also decreases gradually, and the discharge displacement decreases gradually. The discharge pressure falls gradually and the torque needed to drive the compressor becomes smaller gradually. Therefore, the torque does not vary significantly in a short period of time.

When the distal end of the spool 21 abuts on the positioning surface 27, the spool 21 blocks the suction passage 26 from the suction chamber 3*a* as shown in FIGS. 4 and 6.

Consequently, the refrigerant gas stops flowing into the suction chamber 3a from the external refrigeration circuit 35 and the inclined angle of the swash plate 15 goes to its minimum. Since the minimum inclined angle of the swash plate 15 is not zero degrees, the refrigerant gas is discharged into the discharge chamber 3b from the cylinder bores 1a even when the inclined angle of the swash plate 15 is minimized. Even when the inclined angle of the swash plate 15 is minimized, therefore, there are pressure differences between the discharge chamber 3b, the crank chamber 2a and the suction chamber 3a.

The refrigerant gas discharged to the discharge chamber 3b from the cylinder bores 1a flows into the crank chamber 2a via the supply passage 31. The refrigerant gas in the crank chamber 2a flows into the suction chamber 3avia the passage 30 and the through hole 21a, and the refrigerant gas in the suction chamber 3a is drawn into the cylinder bores 1a to be discharged to the discharge chamber 3b. With the inclined angle of the swash plate 15 at the minimum angle, therefore, a circulation path connecting the discharge chamber 3b, the supply passage 31, the crank chamber 2a, the passage 30, the through hole 21a, the suction chamber 3a and the cylinder bores 1a is formed in the compressor. The refrigerant gas discharged to the discharge chamber 3b circulates along this circulation path and will not flow out to the external refrigeration circuit 35. Therefore, no frosting will occur in the evaporator 38. Further, the individual moving parts of the compressor are lubricated by lubricating oil suspended in the refrigerant gas.

When the cooling load of the compressor increases from the state shown in FIGS. 4 and 6, the increase appears as a rise in the temperature in the evaporator 38. When the temperature detected by the temperature sensor 39 exceeds the set value, the computer C excites the solenoid 33. When this excitation happens, the pressure decreasing passage 14 is opened. Under this situation, the refrigerant gas in the crank chamber 2a flows out to the suction chamber 3a via the pressure decreasing passage 14, and the pressure in the crank chamber 2a approaches the suction pressure. As a result, the inclined angle of the swash plate 15 shifts toward the maximum inclined angle from the minimum inclined angle.

As the inclined angle of the swash plate 15 increases, the spool 21 gradually moves away from the positioning surface 27 due to the urging force of the spring 24. This movement gradually increases the cross-sectional area of the passage extending from the suction passage 26 to the suction chamber 3a. The amount of refrigerant gas flowing into the suction chamber 3a from the suction passage 26 therefore increases gradually. As a result, the amount of the refrigerant gas drawn into the cylinder bores 1a from the suction chamber 3a also increases gradually, and the discharge displacement increases gradually. Consequently, the discharge pressure rises gradually and the torque needed to drive the compressor becomes larger gradually. Therefore, the torque does not vary significantly in a short period of time.

Even when the solenoid 33 is de-excited in the state in FIG. 5 due to the OFF action of the activation switch 40 or a drastic change in the engine speed, the inclined angle of the swash plate 15 shifts toward the minimum inclined angle from the maximum inclined angle. When the activation switch 40 is switched on or the drastic change in the engine speed is gone in the state in FIG. 6, the solenoid 33 is excited. When the cooling load of the compressor is large then, the inclined angle of the swash plate 15 shifts toward the maximum inclined angle from the minimum inclined angle.

When the engine E stops, the compressor stops running and the solenoid 33 is de-excited, causing the inclined angle of the swash plate 15 to shift toward the minimum inclined angle. With the operation of the compressor stopped, therefore, the swash plate 15 is held at the minimum inclined angle.

In this embodiment, the supply of the refrigerant gas to the suction chamber 3a from the external refrigeration circuit 35 is allowed or inhibited by moving the spool 21 in response to the inclination of the swash plate 15. The use of this spool 21 prevents frosting from occurring in the evaporator 38 when there is no cooling load on the compressor and effectively suppresses rapid torque change when the swash plate 15 is shifted between the maximum inclined angle and the minimum inclined angle. Although opening and closing of the pressure decreasing passage 14 are frequently repeated in accordance with a change in the cooling load of the compressor, the change-oriented shock can be absorbed because drastic changes in torque are suppressed by the action of the spool 21. In addition, this compressor does not require a conventional control valve and therefore has a lower cost.

A second embodiment of the present invention will now be described with reference to FIGS. 7 through 10. In this embodiment, the members identical to those in the first embodiment are indicated by the same reference numerals and are not explained.

Figure 7:
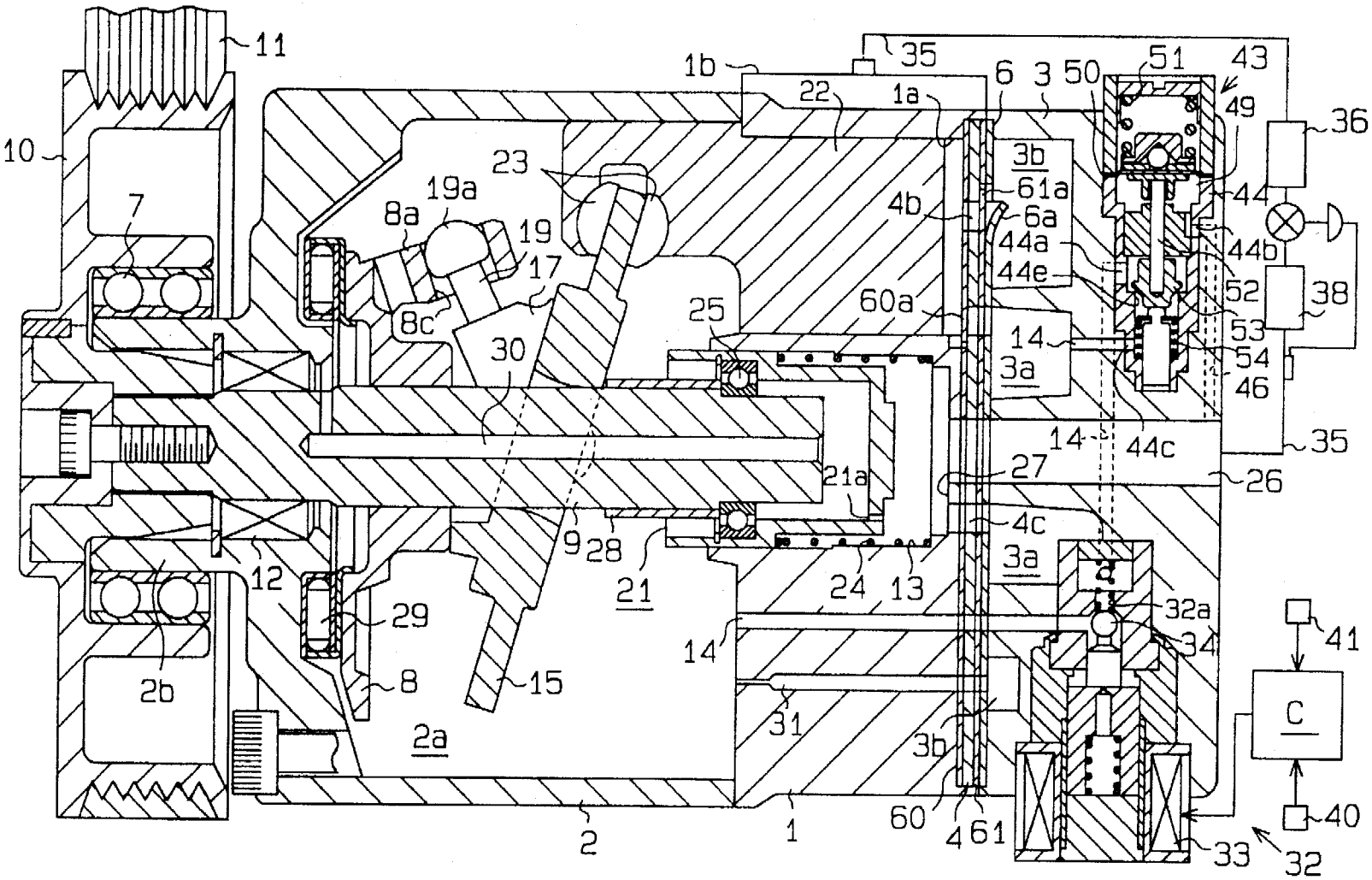
FIG. 7 is a side cross-sectional view of an overall compressor according to the second embodiment.

In this second embodiment, a displacement control valve 43 is attached to the rear housing 3 and is located midway in the pressure decreasing passage 14, as shown in FIG. 7. The pressure in the crank chamber 2a is controlled by this control valve 43. A valve housing 44 which houses the control valve 43 is provided with a first port 44a, a second port 44b and a third port 44c. The first port 44a communicates with the crank chamber 2a via the pressure decreasing passage 14. The third port 44c communicates with the suction chamber 3a via the pressure decreasing passage 14. The second port 44b communicates with the suction passage 26 via an inlet passage 46.

A suction pressure detection chamber 49 communicates with the second port 44b. The suction pressure upstream of the position where the spool 21 blocks the refrigerant gas passage (between the suction passage 26 and the suction chamber 3a) is communicated with the detection chamber 49. The pressure in this detection chamber 49 acts against an adjust spring 51 via a diaphragm 50. The urging force of the adjust spring 51 is transmitted to a valve body 53 via the diaphragm 50 and a rod 52. The urging force of a spring 54 acts on the valve body 53 in the direction to open a valve hole 44e. In accordance with a change in suction pressure in the detection chamber 49, the valve body 53 opens or closes the valve hole 44e. When the valve hole 44e is closed, the first port 44a is disconnected from the third port 44c, causing the crank chamber 2a to be disconnected from the suction chamber 3a.

Figure 8:
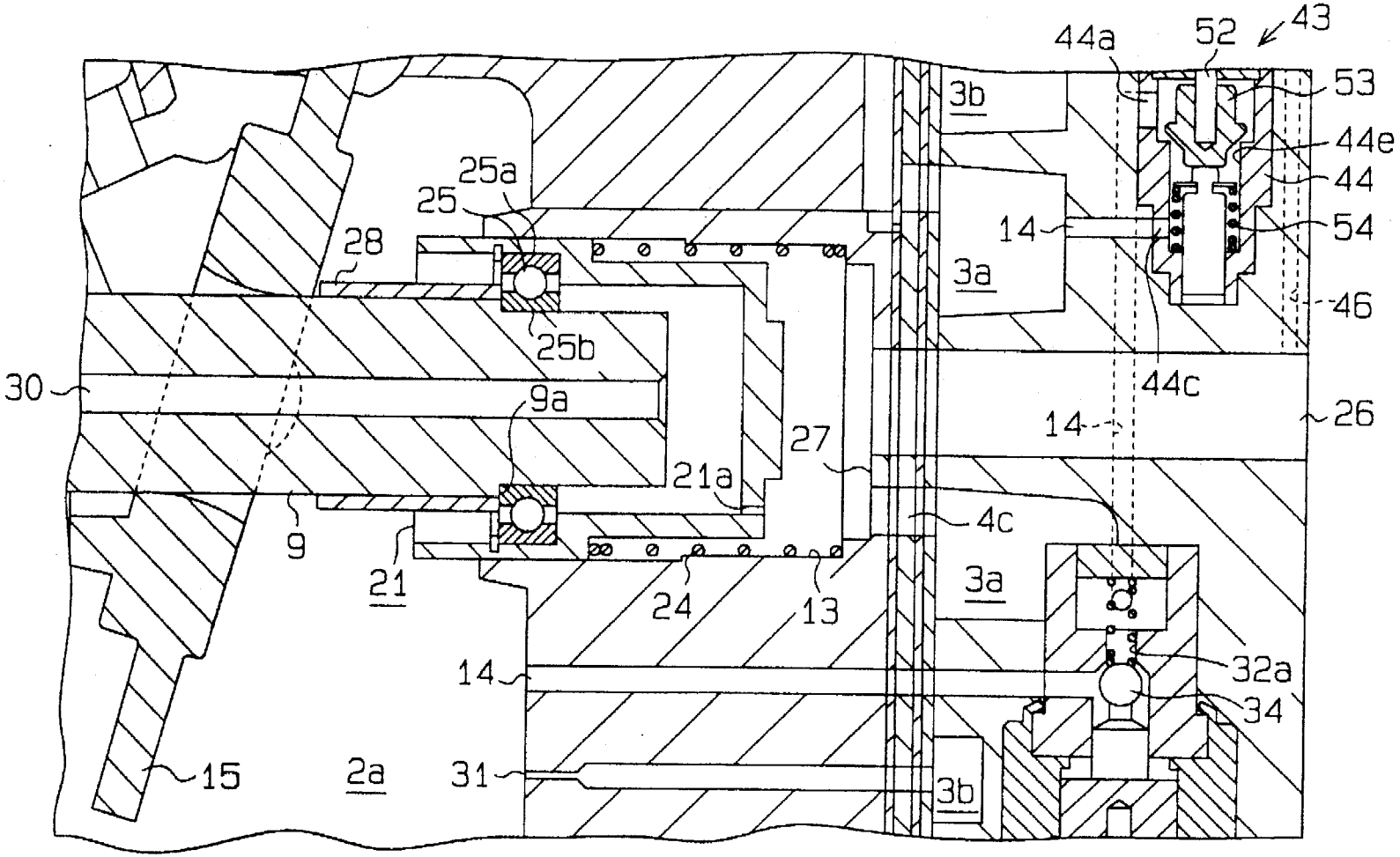
FIG. 8 is an enlarged cross-sectional view of essential parts showing the compressor whose swash plate is at the maximum inclined angle.

In this second embodiment, the temperature sensor 39 is not used. When the cooling load of the compressor is large and the suction pressure is high with the solenoid 33 being excited to open the pressure decreasing passage 14, the pressure in the detection chamber 49 increases and the size of the opening of the valve hole 44e by the valve body 53 increases. As the size of the opening of the valve hole 44e increases, the amount of the refrigerant gas flowing out to the suction chamber 3a from the crank chamber 2a via the pressure decreasing passage 14 increases. As a result, the pressure in the crank chamber 2a falls. Since the suction pressure in the cylinder bores 1*a* is high, the difference between the pressure in the crank chamber 2*a* and the pressure in the cylinder bores 1*a* decreases. Accordingly, the inclined angle of the swash plate 15 becomes larger as shown in FIG. 7 and 8.

When the cooling load of the compressor is small and the suction pressure is low, the size of the opening of the valve hole 44*e* by the valve body 53 becomes smaller and the amount of the refrigerant gas flowing out to the suction chamber 3*a* from the crank chamber 2*a* decreases. Consequently, the pressure in the crank chamber 2*a* rises. As the suction pressure in the cylinder bores 1*a* is low, the difference between the pressure in the crank chamber 2*a* and the pressure in the cylinder bores 1*a* increases. Therefore, the inclined angle of the swash plate 15 becomes smaller.

Figure 9:
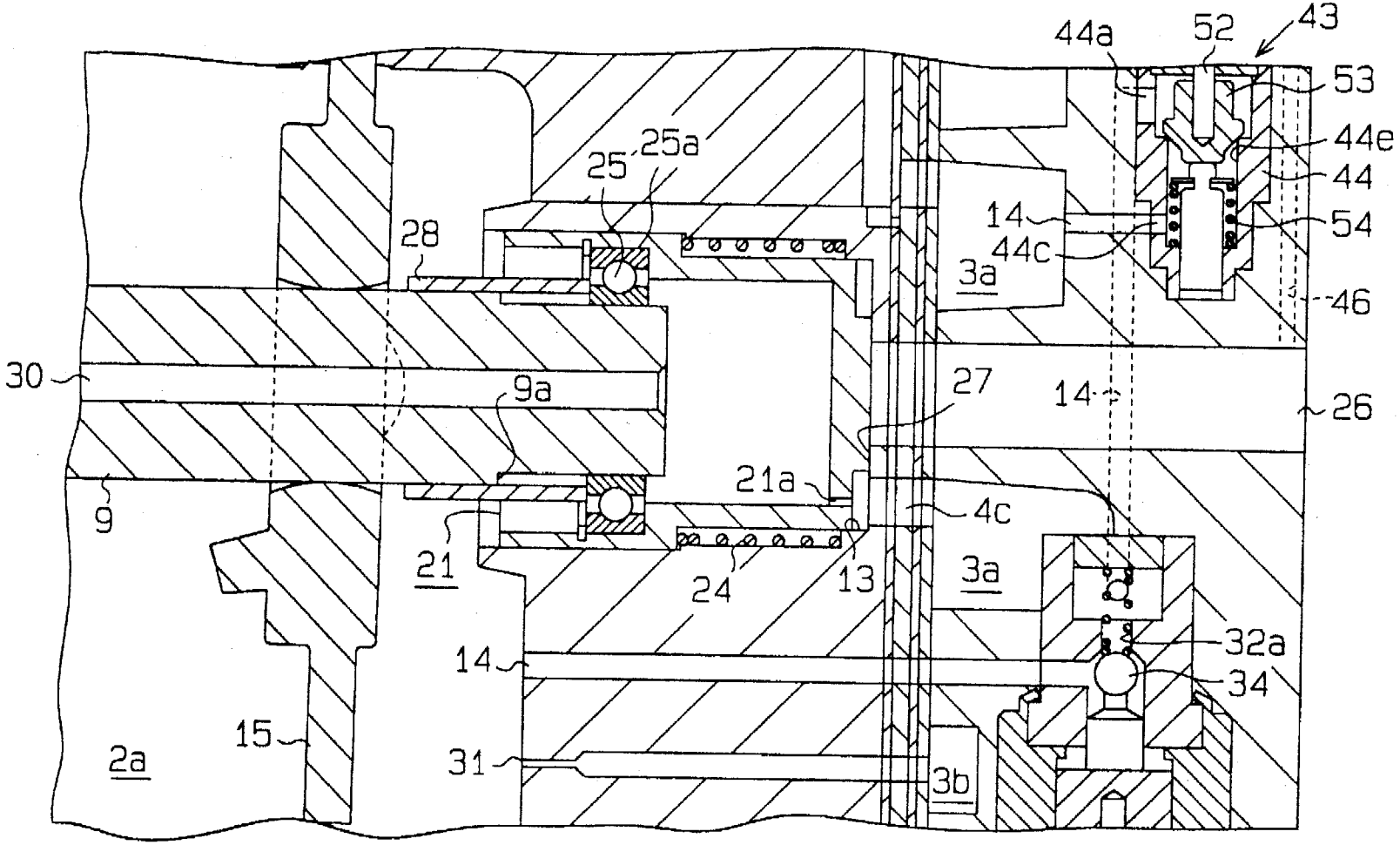
FIG. 9 is an enlarged cross-sectional view of essential parts showing the compressor whose swash plate is at the minimum inclined angle.
Figure 10:
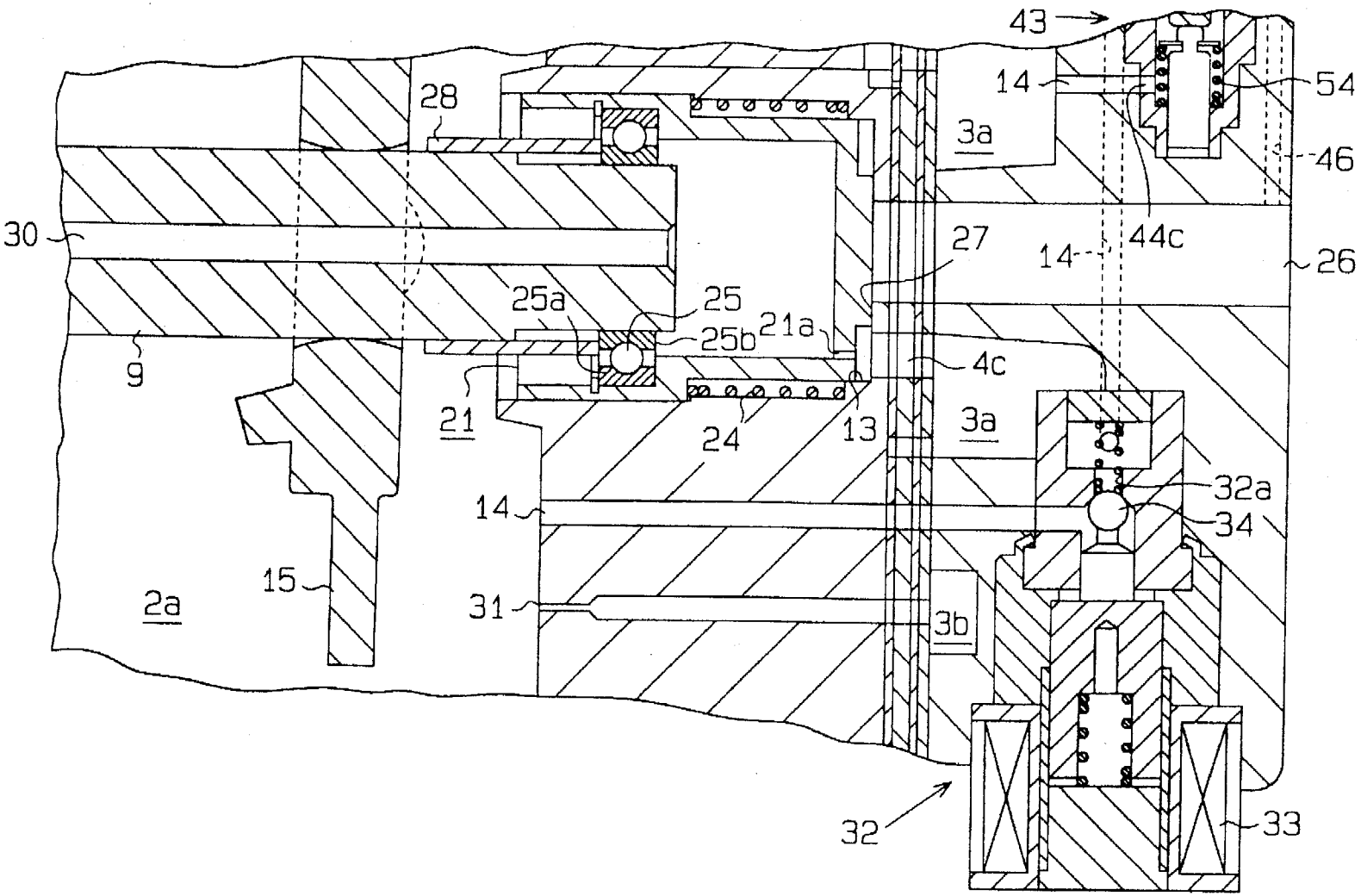
FIG. 10 is an enlarged cross-sectional view of essential parts showing the compressor whose swash plate is at the minimum inclined angle.

When the cooling load of the compressor is very small and the suction pressure is very low, the valve body 53 closes the valve hole 44*e* as shown in FIG. 9. When the solenoid 33 is de-excited, the valve body 34 closes the valve hole 32*a*, blocking the pressure decreasing passage 14 as shown in FIG. 10. Consequently, the pressure in the crank chamber 2*a* rises and the swash plate 15 moves toward its minimum angle. When the solenoid 33 is excited from the state shown in FIG. 10, the pressure decreasing passage 14 is opened and the swash plate 15 moves toward its maximum inclined angle from its minimum inclined angle. In this second embodiment, the inclined angle of the swash plate 15 is variably controlled continuously between the maximum inclined angle and the minimum inclined angle.

A third embodiment of this invention will be described below with reference to FIG. 11 and 12. In this embodiment, the members identical to those in the second embodiment are indicated by the same reference numerals and not explained.

Figure 11:
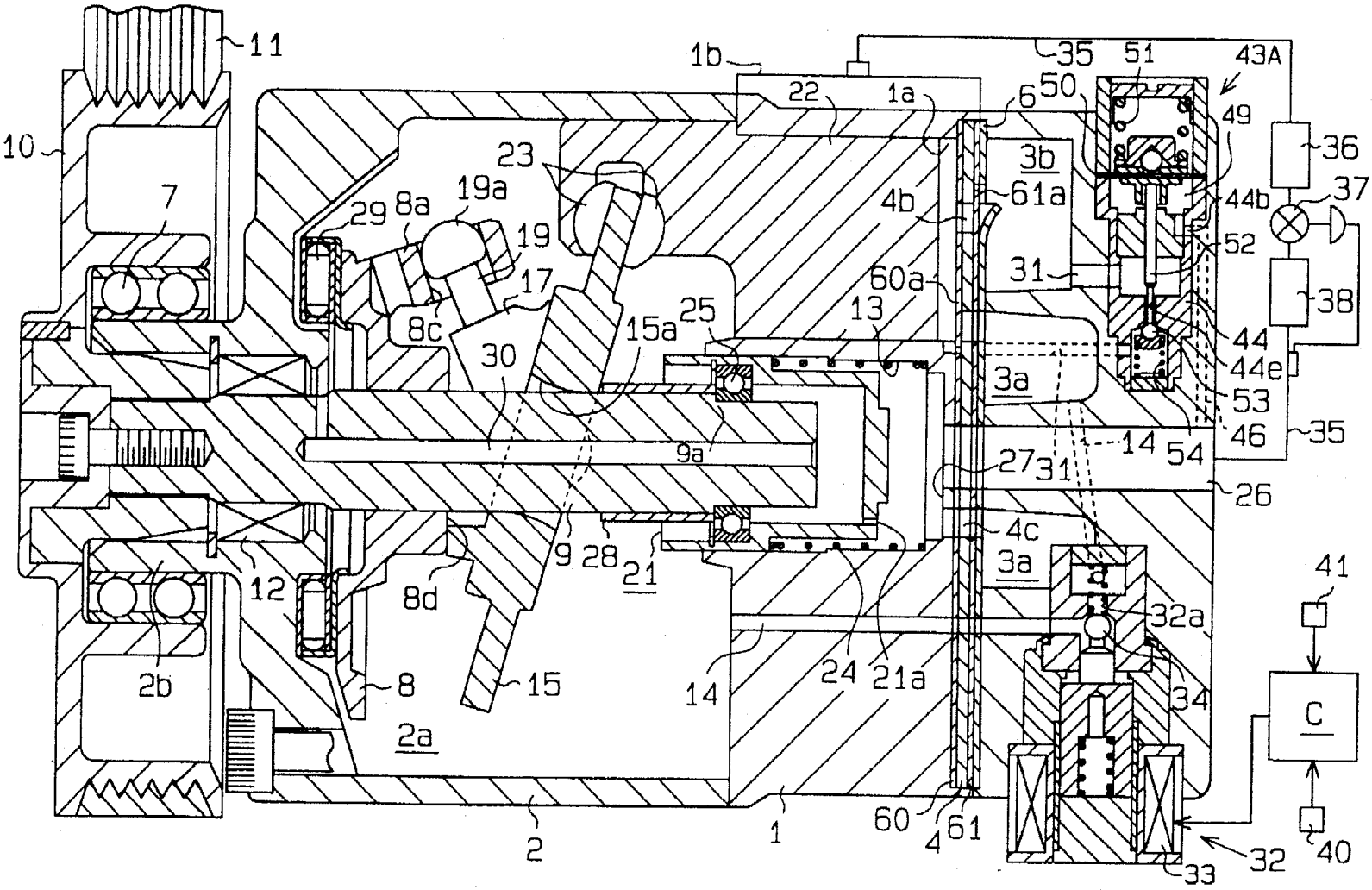
FIG. 11 is a side cross-sectional view of an overall compressor according to the third embodiment.
Figure 12:
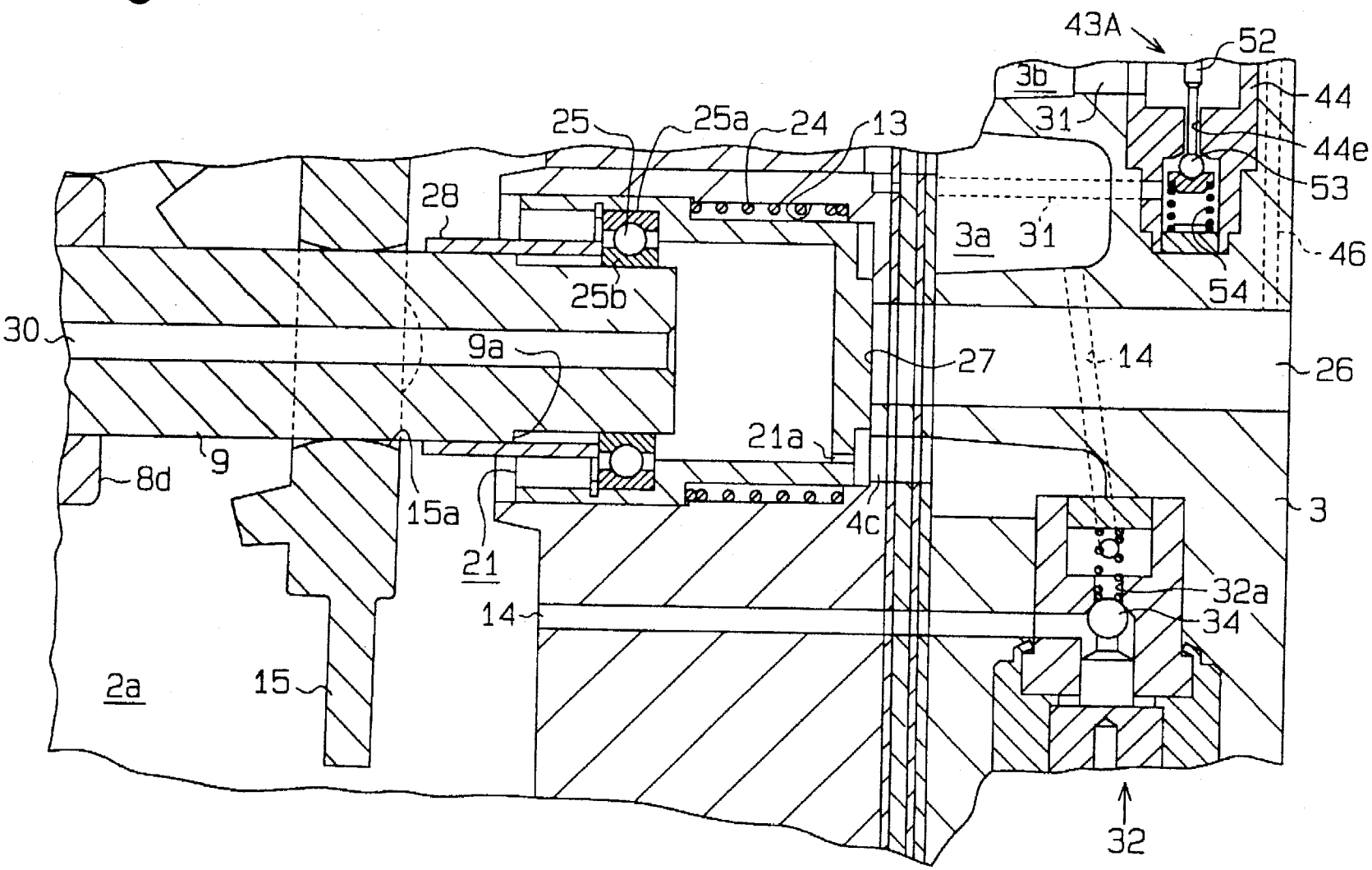
FIG. 12 is an enlarged cross-sectional view of essential parts showing the compressor whose swash plate is at the minimum inclined angle.

In this third embodiment, a displacement control valve 43A is located midway along the supply passage 31 connecting the discharge chamber 3*b* and the crank chamber 2*a* as shown in FIG. 11. The pressure in the detection chamber 49 acts against the adjust spring 51 via the diaphragm 50. The urging force of the adjust spring 51 is transmitted to the valve body 53 via the diaphragm 50 and the rod 52. The urging force of the spring 54 acts on the valve body 53 in the direction to close a valve hole 44*e*. In accordance with a change in suction pressure in the detection chamber 49, the valve body 53 opens or closes the valve hole 44*e*. When the valve hole 44*e* is closed, the discharge chamber 3*b* is disconnected from the crank chamber 2*a*.

When the cooling load of the compressor is large and the suction pressure is high, the pressure in the detection chamber 49 increases and the size of the opening of the valve hole 44*e* by the valve body 53 becomes smaller. As the size of the opening of the valve hole 44*e* becomes smaller, the amount of the refrigerant gas flowing into the crank chamber 2*a* from the discharge chamber 3*b* decreases. As a result, the pressure in the crank chamber 2*a* falls and the inclined angle of the swash plate 15 becomes larger as shown in FIG. 11.

When the cooling load of the compressor is small and the suction pressure is low, the size of the opening of the valve hole 44*e* by the valve body 53 increases and the amount of the refrigerant gas flowing into the crank chamber 2*a* from discharge chamber 3*b* increases. Consequently, the pressure in the crank chamber 2*a* rises and the inclined angle of the swash plate 15 becomes smaller as shown in FIG. 12.

In this third embodiment, as in the second embodiment, the inclined angle of the swash plate 15 is variably controlled continuously, between the maximum inclined angle and the minimum inclined angle.

Figure 13:
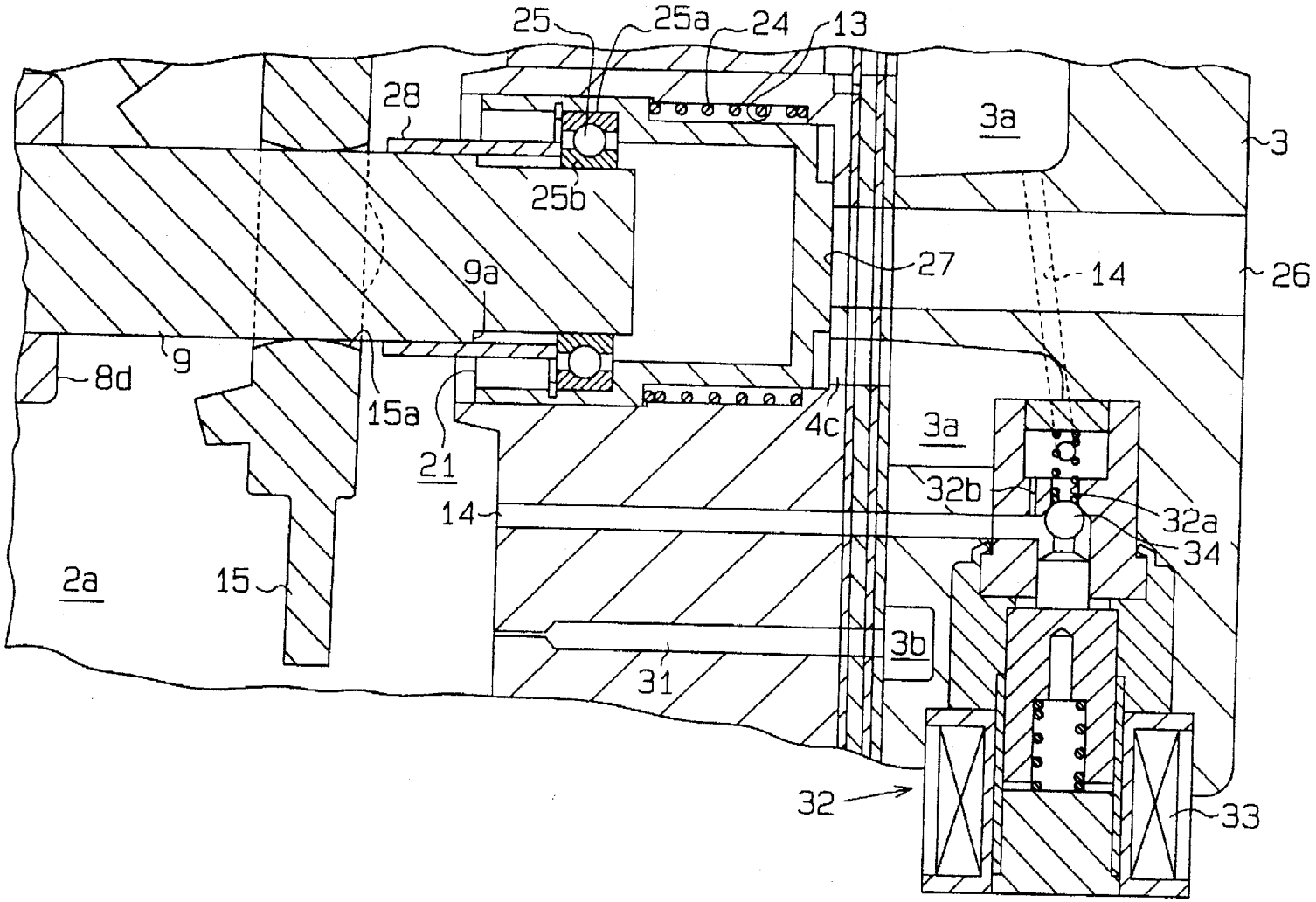
FIG. 13 is an enlarged cross-sectional view of essential parts showing the compressor according to the fourth embodiment.

A fourth embodiment of this invention will be described below with reference to FIGS. 13. In this embodiment, the members identical to those in the first embodiment are indicated by the same reference numerals and not explained.

In this fourth embodiment, a passage 32*b* is formed in the electromagnetic valve 32, and the passage 30 in the drive shaft 9 and the through hole 21*a* in the spool 21 are omitted. When the solenoid 33 of the electromagnetic valve 32 is de-excited, the pressure decreasing passage 14 is blocked and the pressure in the crank chamber 2*a* rises. Consequently, the inclined angle of the swash plate 15 becomes smaller and the spool 21 blocks the suction passage 26 from the suction chamber 3*a*. In this situation, the refrigerant gas in the crank chamber 2*a* flows out to the suction chamber 3*a* via the pressure decreasing passage 14 and the passage 32*b*.

Consequently, in this fourth embodiment, the refrigerant gas circulates along the circulation path in the compressor, when the supply of the refrigerant gas to the suction chamber 3*a* from the external refrigeration circuit 35 is inhibited. Therefore, the individual portions in the compressor are lubricated by the lubricating oil suspended in the refrigerant gas.

What is claimed is:

1. A compressor having a swash plate mounted on a drive shaft for an integral rotation in a crank chamber and a piston coupled to the swash plate and disposed in a cylinder bore, the rotation of the drive shaft being converted to a reciprocating movement of the piston to vary a capacity of the cylinder bore to compress gas which is supplied to the cylinder bore from an external circuit by way of a suction chamber and discharged to a discharge chamber, said swash plate being tiltable between a maximum inclining angle and a minimum inclining angle with respect to an axis of the drive shaft according to a difference between pressures in the crank chamber and the suction chamber, wherein said swash plate controls a displacement of the compressor to be maximum and minimum when the swash plate is at the maximum inclining angle and at the minimum inclining angle, respectively, and wherein a pressure passage for adjusting the pressure in the crank chamber is selectively open and closed in accordance with an operation status of the compressor, said compressor comprising:

said pressure passage connecting the crank chamber and the suction chamber;

switching means for selectively opening and closing the pressure passage, wherein said swash plate is inclined toward the maximum inclining angle when the pressure passage is open to release the pressure in the crank chamber to the suction chamber, and said swash plate is inclined toward the minimum inclining angle when the pressure passage is closed to increase the pressure in the crank chamber; and disconnecting means for disconnecting the external circuit with the suction chamber in association with the swash plate driven to the minimum inclining angle.

2. The compressor as set forth in claim 1, wherein said switching means includes an electromagnetic valve.

3. The compressor as set forth in claim 2, wherein said electromagnetic valve is energized to open the pressure passage, and deenergized to close the pressure passage.

4. The compressor as set forth in claim 1 further comprising a first control valve disposed in the pressure passage, wherein said pressure passage has a sectional area variable in association with said first control valve responding to the pressure of the gas supplied from the external circuit to the suction chamber.

5. The compressor as set forth in claim 4, wherein said first control valve operates in response to the pressure generated upstream of the disconnecting means.

6. The compressor as set forth in claim 1 further comprising:

an internal passage selectively connected and disconnected with the external circuit;

wherein said internal passage includes:

a release passage connecting the crank chamber with suction chamber to release the gas in the crank chamber to the suction chamber;

a supply passage connecting the discharge chamber with the crank chamber to supply he compressed gas from the discharge chamber to the crank chamber, wherein the swash plate is inclined toward the minimum inclining angle; and a circulating passage including the release passage and the supply passage, said circulating passage being defined upon the disconnection of the internal passage with the external circuit.

7. The compressor as set forth in claim 6 further including a second control valve disposed in said supply passage, wherein said supply passage has a sectional area variable in association with said second control valve responding to the pressure of the gas supplied from the external circuit to the suction chamber.

8. The compressor as set forth in claim 7, wherein said second control valve operates in response to the pressure generated upstream of the disconnecting means.

9. The compressor as set forth in claim 1, wherein said disconnecting means includes:

a suction passage for connecting the suction chamber with the external circuit;

a spool movable along the axis of the drive shaft, said spool having an end surface for closing the suction passage and disconnecting the suction chamber from the external circuit when the swash plate is at the minimum inclining angle.

10. The compressor as set forth in claim 9, wherein said spool closes the suction passage to hold the swash plate at the minimum inclining angle.

11. The compressor as set forth in claim 9 further comprising:

said spool having a hollow cylindrical shape; and a bearing disposed within the spool to rotatably support the drive shaft.

12. The compressor as set forth in claim 11 further comprising a pipe movable along the axis of said drive shaft for transmitting the inclining motion of the swash plate to the spool by way of said bearing.

13. A compressor having a swash plate mounted on a drive shaft for an integral rotation in a crank chamber and a piston coupled to the swash plate and disposed in a cylinder bore, the rotation of the drive shaft being converted to a reciprocating movement of the piston to vary a capacity of the cylinder bore to compress gas which is supplied to the cylinder bore from an external circuit by way of a suction chamber and discharged to a discharge chamber, said swash plate being tiltable between a maximum inclining angle and a minimum inclining angle with respect to an axis of the drive shaft according to a difference between pressures in the crank chamber and the suction chamber, wherein said swash plate controls a displacement of the compressor to be maximum and minimum when the swash plate is at the maximum inclining angle and at the minimum inclining angle, respectively, and wherein a pressure passage for adjusting the pressure in the crank chamber is selectively open and closed in accordance with instruction of an external computer, said instruction being based on an operation status of the compressor, said compressor comprising:

said pressure passage connecting the crank chamber and the suction chamber;

an electromagnetic valve for selectively opening and closing the pressure passage in accordance with the instruction of the external computer, wherein said swash plate is inclined toward the maximum inclining angle when the pressure passage is open to release the pressure in the crank chamber to the suction chamber, and said swash plate is inclined toward the minimum inclining angle when the pressure passage is closed to increase the pressure in the crank chamber; and a spool movable in association with the inclining motion of the swash plate, whereby said spool disconnects the external circuit with the suction chamber when the swash plate is at the minimum inclining angle.

14. The compressor as set forth in claim 13, wherein said electromagnetic valve is energized to open the pressure passage, and deenergized to close the pressure passage.

15. The compressor as set forth in claim 7 further comprising a first control valve disposed in the pressure passage, wherein said pressure passage has a sectional area variable in association with said first control valve responding to the pressure of the gas supplied from the external circuit to the suction chamber.

16. The compressor as set forth in claim 15, wherein said first control valve operates in response to the pressure generated upstream of the spool.

17. The compressor as set forth in claim 14 further comprising:

an internal passage selectively connected and disconnected with the external circuit;

wherein said internal passage includes:

a release passage connecting the crank chamber with suction chamber to release the gas in the crank chamber to the suction chamber;

a supply passage connecting the discharge chamber with the crank chamber to supply he compressed gas from the discharge chamber to the crank chamber, wherein the swash plate is inclined toward the minimum inclining angle; and a circulating passage including the release passage and the supply passage, said circulating passage being defined upon the disconnection of the internal passage with the external circuit.

18. The compressor as set forth in claim 17 further including a second control valve disposed in said supply passage, wherein said supply passage has a sectional area variable in association with said second control valve responding to the pressure of the gas supplied from the external circuit to the suction chamber.

19. The compressor as set forth in claim 18, wherein said second control valve operates in response to the pressure generated upstream of the spool.

20. The compressor as set forth in claim 13 further including:

a suction passage for connecting the suction chamber with the external circuit; and said spool having an end surface for closing the suction passage and disconnecting the suction chamber from the external circuit when the swash plate is at the minimum inclining angle.

* * * * *

UNITED STATES PATENT AND TRADEMARK OFFICE

CERTIFICATE OF CORRECTION

PATENT NO. : 5,681,150
DATED : October 28, 1997
INVENTOR(S) : Masahiro Kawaguchi, Masanori Sonobe, Ken Suitou, and Tomohiko Yokono It is certified that error appears in the above-indentified patent and that said Letters Patent is hereby corrected as shown below:

Column 4, line 16, after "6" (second occurrence) insert a comma --,--.

Column 11, line 13, change "he" to --the--.

Column 12, line 41, change "he" to --the--.

Signed and Sealed this

Seventh Day of April, 1998

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,681,150

DATED : October 28, 1997

INVENTOR(S) : Masahiro Kawaguchi, Masanori Sonobe, Ken Suitou and Tomohiko Yokono It is certified that error appears in the above-identified patent and that said Letters Patent is hereby corrected as shown below:

Column 10, line 55, the first occurrence of "with" should read --from--; lines 55 and 56, "in association with the swash plate" should read --when the swash plate is--.

Signed and Sealed this

Twenty-first Day of July, 1998

Bruce Lehman

*Attest:*

BRUCE LEHMAN

*Attesting Officer*

*Commissioner of Patents and Trademarks*